US005284814A

United States Patent [19]

Taguchi et al.

[11] Patent Number: 5,284,814

[45] Date of Patent: Feb. 8, 1994

[54] THERMAL TRANSFER PRINTING METHOD AND PRINTING MEDIA EMPLOYED THEREFOR

[75] Inventors: Nobuyoshi Taguchi; Akihiro Imai, both of Ikoma; Yasuo Fukui, Kadoma, all of Japan

[73] Assignee: Matsushita Electric Industrial Co., Ltd., Osaka, Japan

[21] Appl. No.: 769,851

[22] Filed: Oct. 2, 1991

[30] Foreign Application Priority Data

Oct. 2, 1990 [JP] Japan ..... 2-265641
Oct. 19, 1990 [JP] Japan ..... 2-282112
Oct. 19, 1990 [JP] Japan ..... 2-282113

[51] Int. Cl.[5] ..... B41M 5/035; B41M 5/38

[52] U.S. Cl. ..... 503/227; 156/235; 428/195; 428/913; 428/914

[58] Field of Search ..... 8/471; 428/195, 913, 428/914; 156/235

[56] References Cited

U.S. PATENT DOCUMENTS 4,923,848 5/1990 Akada et al. ..... 503/227
5,006,502 4/1991 Fujimura et al. ..... 503/227
5,064,807 11/1991 Yoshida et al. ..... 503/227

FOREIGN PATENT DOCUMENTS 0378291 7/1990 European Pat. Off. ..... 428/195
1567636 5/1969 France ..... 430/258

OTHER PUBLICATIONS

Abstract of JP 61-295094 (Dec. 25, 1986).
Abstract of JP 63-17086 (Jan. 25, 1988).

*Primary Examiner*—B. Hamilton Hess
*Attorney, Agent, or Firm*—Wenderoth, Lind & Ponack

[57] ABSTRACT

A thermal transfer printing method which employs a dyeing layer transfer member having at least a dyeing layer on a base material, an ink transfer member having at least an ink layer containing a subliming dye on a base material, recording intermediate member having at least a base material, and an image-receptor. The thermal transfer printing method includes the steps of thermally transferring the dyeing layer of the dyeing layer transfer member onto the recording intermediate member, thermally transferring and recording ink of the ink transfer member onto the transferred dyeing layer according to image signals, and further thermally transferring the recorded dyeing layer onto the image-receptor. The disclosure also relates to printing media employed for effecting the method. It may be so arranged to preliminarily form the dyeing layer on the recording intermediate member, and in this case, the dyeing layer transfer member and the process for its thermal transfer may be dispensed with. By the present invention, it becomes possible to print high quality images on plain paper at high speed.

9 Claims, 4 Drawing Sheets

THERMAL TRANSFER PRINTING METHOD AND PRINTING MEDIA EMPLOYED THEREFOR

BACKGROUND OF THE INVENTION

The present invention generally relates to a printing method, and more particularly, to a thermal transfer printing method capable of printing high quality images on a plain paper sheet, and printing media to be employed for said method.

In the field of the thermal transfer printing, there has been known a dye thermal transfer printing method which is the only printing technique superior in the compact size, facilitated maintenance, and instantaneous operation of an apparatus employed therefor, and capable of providing an image at high quality equal to that in the color photography. In the dye thermal transfer printing method as referred to above, it is so arranged that a transfer member having a coloring material layer containing a sublimining dye provided on a thin film base, and an image-receptor or image receiver provided with a dyeing layer on a thick film such as a synthetic paper or the like, are overlapped each other, and by transferring the subliming dye into the dyeing layer through employment of a thermal recording head, a color mixed image of dye molecules is recorded or printed.

The printing is generally effected by driving the image-receptor, and causing a transfer member to follow the movement through frictional force between the image-receptor and the transfer member.

On the other hand, in order to affix the printed image onto various places, there has also been conventionally proposed a practice which employs tack sheets. In this practice, the image-receptor has a double-sheet structure, and an adhesive material is applied onto a reverse surface of a base material formed with an upper dyeing layer so as to be fixed on a support member provided with a lower parting layer, whereby after the printing, the upper layer is separated or peeled off for being fixed on a post-card, etc.

Meanwhile, printing of characters or letters has been effected on a plain paper sheet smoothed on its surface through employment of a molten ink transfer member.

As described above, the printed image by the dye thermal transfer printing method is formed on the specially prepared paper sheet, and therefore, running cost tends to be high, thus preventing said printing technique from spreading widely for general applications.

Moreover, in the recent times of multi-media, information includes images mixed with characters, and despite of a strong demand for printing such information on a plain paper in the similar manner as in a copying apparatus, it has been impossible to obtain an image at high quality on a plain paper sheet by the conventional dye thermal transfer printing method.

SUMMARY OF THE INVENTION

Accordingly, an essential object of the present invention is to provide a thermal transfer printing method and printing media employed therefor, which are .capable of providing a pictorial image at high quality which has been obtained only on an expensive special paper up to the present, irrespective of the kind of image-receptors, even when the image is mixed with characters.

Another object of the present invention is to provide a thermal transfer printing method and printing media employed therefor as described above, which may be readily adopted in the actual applications in an efficient manner at low cost.

In accomplishing these and other objects, according to one aspect of the present invention, there is provided a thermal transfer printing method which employs a dyeing layer transfer member having at least a dyeing layer on a base material, an ink transfer member having at least an ink layer on a base material, a recording intermediate member having at least a base material, and an image-receptor. The thermal transfer printing method includes the steps of thermally transferring the dyeing layer of said dyeing layer transfer member onto said recording intermediate member, thermally transferring and recording ink of said ink transfer member onto said transferred dyeing layer, and further thermally transferring said recorded dyeing layer onto said image-receptor from said recording intermediate member.

In another aspect of the present invention, the thermal transfer printing method employs a dyeing layer transfer member having at least a dyeing layer on a base material, a dye transfer member having at least a dye layer on a base material, a molten ink transfer member having at least a molten ink layer on a base material, a recording intermediate member having at least a base material, and an image-receptor, and includes the steps of thermally transferring the dyeing layer of said dyeing layer transfer member onto the recording intermediate member, thermally transferring the dye of said dye transfer member onto said transferred dyeing layer, also thermally transferring and recording the ink of said molten ink transfer member onto said transferred dyeing layer according to image signals, and further thermally transferring said recorded dyeing layer onto said image-receptor.

In still another aspect of the present invention, the thermal transfer printing method employs a dyeing layer transfer member having at least a dyeing layer on a base material, a dye transfer member having at least a dye layer on a base material, a molten ink transfer member having at least a molten ink layer on a base material, a recording intermediate member having at least a base material, and an image-receptor, includes the steps of thermally transferring the dyeing layer of said dyeing layer transfer member onto the recording intermediate member, thermally transferring the dye of said dye transfer member onto said transferred dyeing layer according to image signals, also thermally transferring and recording the ink of said ink transfer member onto said printing intermediate member not transferred with the dyeing layer according to image signals, and further thermally transferring the dyeing layer recorded by the dye and the recorded molten ink onto said image-receptor from said recording intermediate member.

In a further aspect of the present invention, the thermal transfer printing method employs a transfer member including a portion in which at least a dye layer and a dyeing layer are formed by lamination through at least a parting layer (or separating layer) and a molten ink portion having at least a molten ink layer, successively formed on a base material, a recording intermediate member having at least a base material, and an image-receptor, and includes the steps of thermally transferring and recording the dyeing layer of said transfer member onto the recording intermediate member according to image signals and simultaneously, subjecting the dye in said dye layer to thermal diffusion transfer recording into said dyeing layer, thermally transferring and recording the molten ink onto said dyeing layer, and thermally transferring said recorded dyeing layer onto said image-receptor.

In a still further aspect of the present invention, there is provided a dyeing layer transfer member or transfer member for use in a thermal transfer printing method as described above, wherein at least the dyeing layer is provided on the base material less than 50 microns in thickness, with a separating strength between said base material and the layer formed thereon being more than 5g/25mm.

In another aspect of the present invention, there is also provided a dyeing layer transfer member or transfer member for use in a thermal transfer printing method as described above, wherein said dyeing layer is formed into lamination of more than two layers, with surface energy of the dyeing layer resin to be formed on the dyeing layer resin contacting said base material being set to be larger than that of the latter.

In still another aspect of the present invention, there is provided a thermal transfer printing method which employs a recording intermediate member having at least a base material, and preliminarily provided with a dyeing layer partially or totally formed thereon by painting or thermal means, the ink transfer member as referred to earlier, and an image-receptor. The thermal transfer printing method includes the steps of thermally transferring and recording the ink of the ink transfer member according to image signals, and thermally transferring said recorded dyeing layer onto the image-receptor.

In a still further aspect of the present invention, said thermal transfer printing method employs the recording intermediate member in which a separating layer is preliminarily provided on the surface of the base material.

By the method according to the present invention as described so far, images at high quality which can be obtained only on the expensive special paper may be obtained irrespective of the image-receptors, even when the images are mixed with characters. Thus, printing less dependent on the quality of paper can be effected onto the bond paper, plain paper, etc. Particularly, even with respect to the high speed printing, or high temperature recording, stable recording may be effected without separation between the recording intermediate member and the dyeing layer recorded thereon, and the recorded dyeing layer can be thermally transferred stably onto any image-receptor. Moreover, said dyeing layer may be selectively transfer, and selective image is formed also on the image-receptor, without any feeling of disorder as in a coating.

BRIEF DESCRIPTION OF THE DRAWINGS

These and other objects and features of the present invention will become apparent from the following description taken in conjunction with the preferred embodiment thereof with reference to the accompanying drawings, in which.

DETAILED DESCRIPTION OF THE INVENTION

Figure 1:
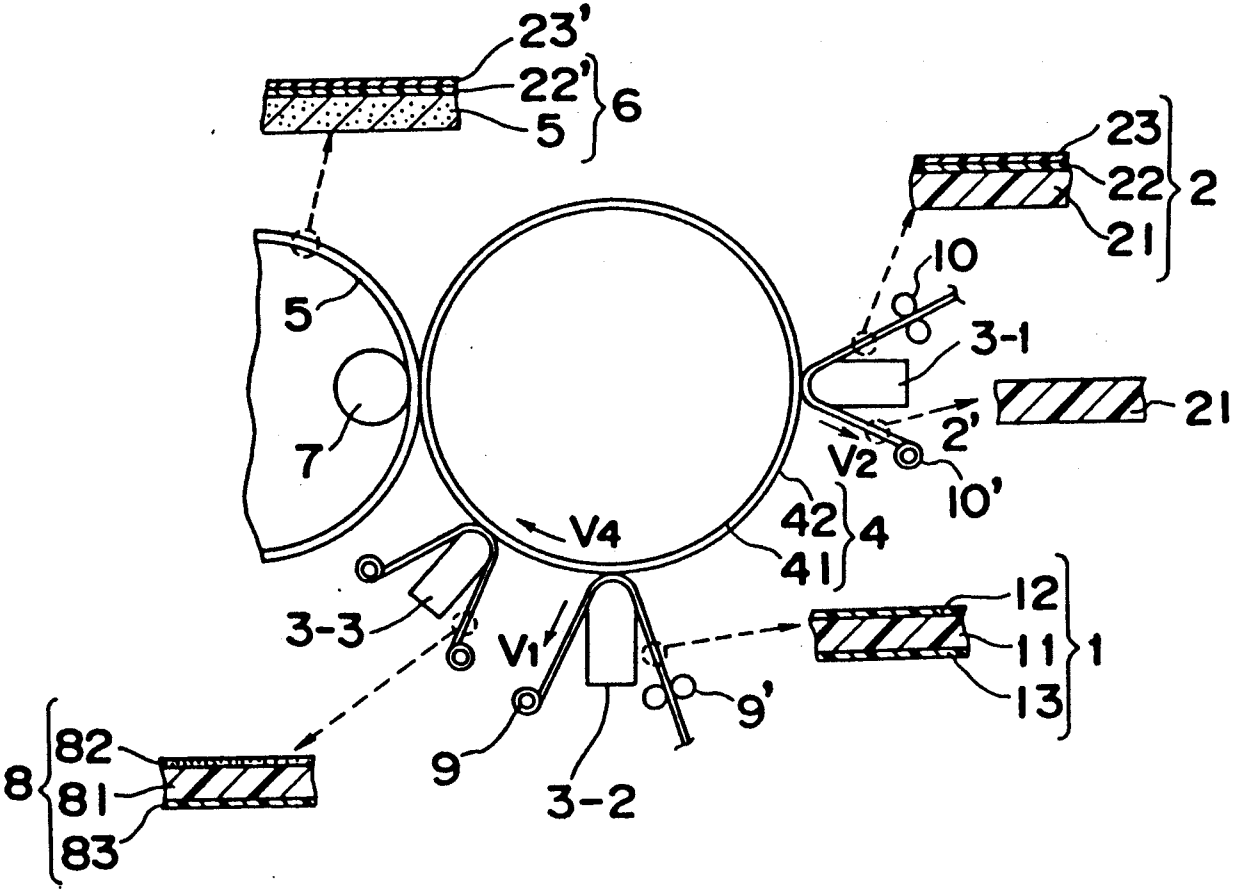
FIG. 1 is a schematic side elevational view of an arrangement for explaining a thermal transfer printing method and printing media employed therefor according to one preferred embodiment of the present invention, in which fragmentary cross sections on a large scale are shown for respective essential portions surrounded by dotted circles.

Before the description of the present invention proceeds, it is to be noted that like parts are designated by like reference numerals throughout the accompanying drawings.

Referring now to the drawings, a thermal transfer printing method and print media employed therefor according to the present invention will be described hereinafter.

In the first place, essential points of the present invention as summarized are as follows.

Fundamentally, a dyeing layer including dyeing layer portions is selectively transferred and recorded (or printed) on a recording or printing intermediate member (referred to as a recording intermediate member hereinafter). It may be so arranged to preliminarily provide the dyeing layer on the recording intermediate member by painting or thermal means. On said dyeing layer, a subliming dye of a dye layer is thermally transferred and recorded. Subsequently, characters, etc. are recorded or printed (referred to as "recorded" hereinafter) onto the dyeing layer or onto the recording intermediate layer without the dyeing layer by a melting or molten ink (referred to as molten ink hereinafter). The color mixture image by the dye molecules and the character image by the molten ink as recorded in the above described manner are separated at a boundary face with respect to the recording intermediate member by heat and/or pressure and transferred onto an image-receptor.

There are cases where a base material of the dyeing layer and that of the dye layer are the same or they are different from each other. In the case where the base material of the dyeing layer and that of the dye layer are the same, there are further cases where the dyeing layer and the dye layer are arranged by a face order, and the dyeing layer is applied upon the dye layer. A base material for the molten ink layer may be the same as that of the dye layer, or the base materials for the dyeing layer, dye layer and molten ink layer may be of the same material.

The boundary face between the dyeing layer and the base material should be fixed under a metastable condition. Therefore, surface energy of the dyeing layer resin contacting the base material is low, and since the dyeing layer resin formed thereon adheres to an image-receptor of paper or the like at the final process to be transferred thereon, it is desired that the surface energy thereof should preferably be higher.

Moreover, it may be so arranged to subject the dyeing layer transfer member and the recording intermediate member, and the recording intermediate member and the dye transfer member (transfer member), to independent running or moving control, whereby sharing stress acting on the boundary face between the dyeing layer and the base material during recording or between the transferred dyeing layer and the recording intermediate member may be alleviated for preventing separation at the boundary face. In this case, it is also effective to reduce a friction coefficient between the recording intermediate member and the transfer member. This may be realized by providing a separating layer (or lubricant or lubricity layer: referred to as a lubricity layer hereinafter) or by applying lubricity to the dyeing layer of the recording intermediate member.

For driving the dye transfer member by the recording intermediate member provided with the dyeing layer, the friction coefficients of the dyeing layer and the dye layer should preferably be larger within a range capable of being recorded, and in this case, the separating layer (lubricity layer) on the dye layer is not necessary.

By setting glass-transition temperature of the dyeing layer below 90° C., the final image which can be readily transferred onto the image-receptor after recording may be obtained.

Figure 2:
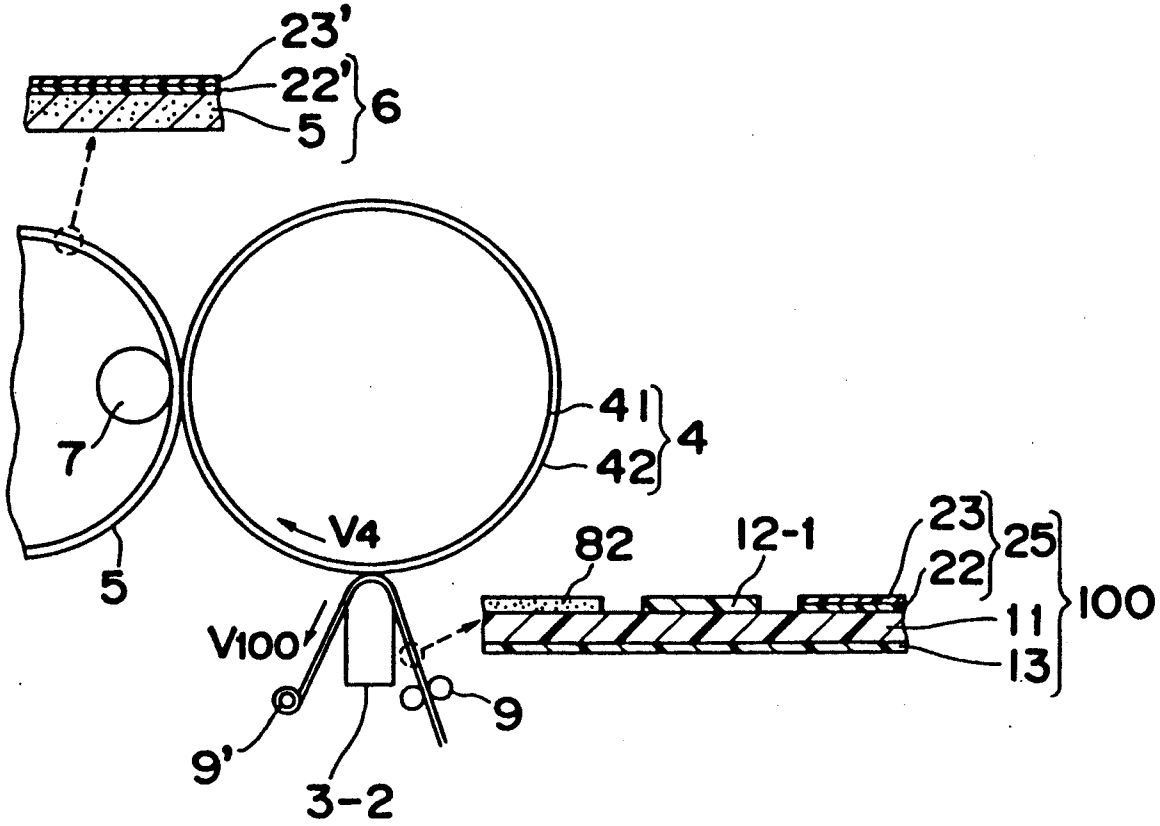
FIG. 2 is a view similar to FIG. 1, which particularly relates to a second embodiment of the present invention.
Figure 7:
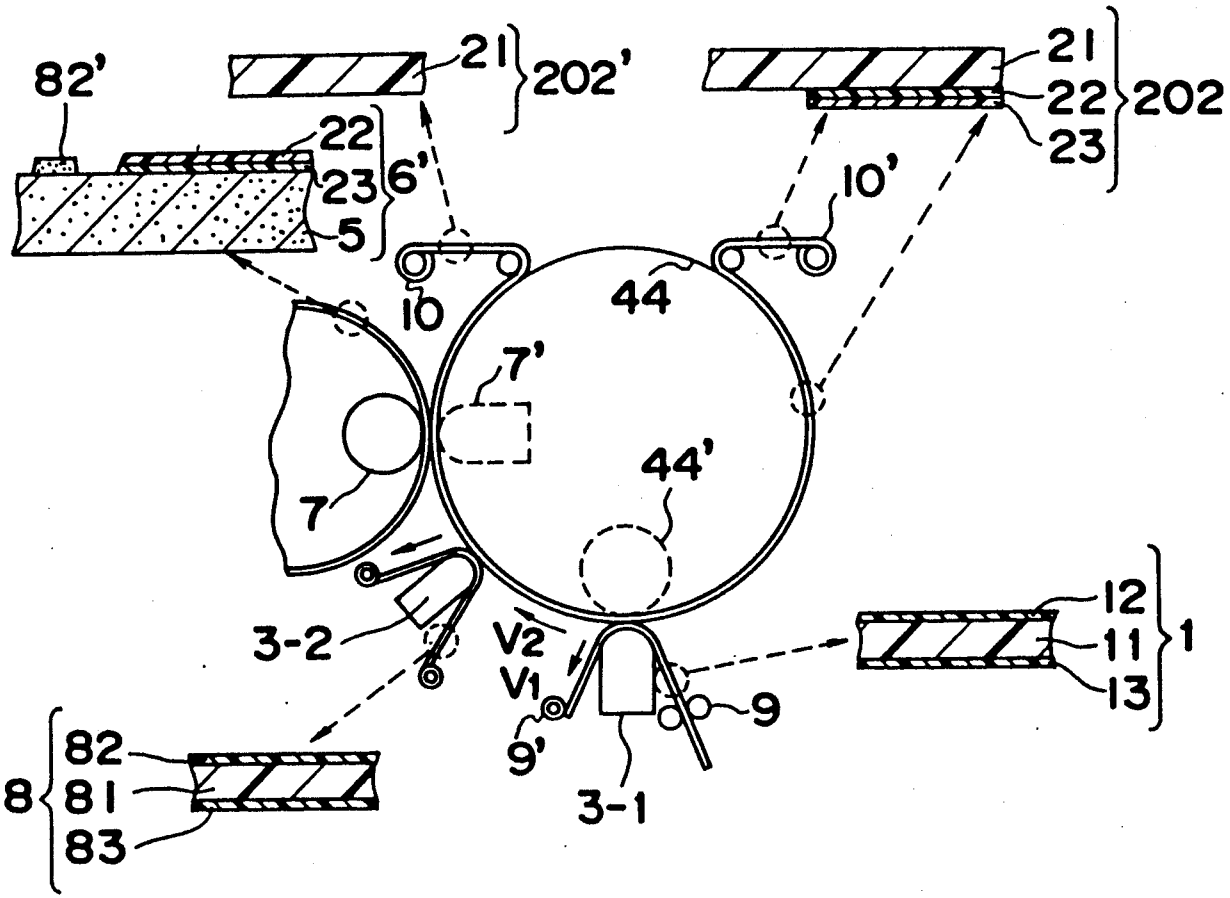
FIG. 7 is a view similar to FIG. 1, which particularly relates to a third embodiment of the present invention.

It should be noted here that, in FIGS. 1, 2 and 7 showing arrangements for describing thermal transfer printing method according to the present invention, constructions of essential portions surrounded by dotted circles are given in fragmentary cross sections on a large scale led out therefrom by dotted arrows in each of the figures for quick reference.

Referring to FIG. 1 showing an arrangement for explaining the thermal transfer printing method according to one preferred embodiment of the present invention, there is provided a dyeing layer transfer member 2 held between a recording intermediate member 4 formed into a drum-like configuration and a thermal head 3-1, whereby thermal transfer and recording of the dyeing layer including layers 22, 23 is effected onto a surface layer 42 of the recording intermediate member 4. The recording intermediate member 4 may be formed into a sheet-like shape such as a polythylene terephthalate film (PET) or the like, and the surface of said PET film may be roughened by fine particles or a lapping paper. Moreover, a separating layer and a soft layer of silicon rubber or the like (not shown) may be provided on the PET film by 5 to 10 microns in thickness. The dyeing layer 22, 23 is subjected to selective transfer only for a portion where the dye is printed later or to the transfer for a predetermined whole area. Numeral 2' in FIG. 1 represents the state after the dyeing layer 22, 23 has been transferred. A thin separating layer of about 1 micron thick may be formed on the surface of a base material 21. Subsequently, through employment of a dye transfer member 1 and the thermal head 3-2, the subliming dye in a dye layer 12 on the dye transfer member 1 is subjected to thermal diffusion transfer into the dyeing layer 22, 23 recorded on the recording intermediate member 4. Then, through employment of a molten ink transfer member 8 and a thermal head 3-3, molten ink 82 is subjected to thermal transfer and recording onto the recorded dyeing layer 22, 23 on the recording intermediate member 4 or onto the recording intermediate member 4 not recorded with the dyeing layer 22, 23. In the case of a printing apparatus not required to print characters, the portion by the combination of the molten ink transfer member 8 and the thermal head 3-3 is not required. The order of the processing by the thermal heads 3-2 and 3-3 may be reversed. Finally, by thermally transferring the image recorded in or on the dyeing layer 22, 23 provided on the recording intermediate member 4, onto the image-receptor 5 together with the dyeing layer 22, 23 through employment of a heat roller 7, a high quality image by the dye and molten thermal transfer printing can be obtained without depending on the quality of the material for the image-receptor 5. In the case where the molten ink 82 is printed on the recording intermediate member 4 without the dyeing layer also, the image may be obtained by similarly transferring onto the image-receptor 5. Numeral 6 shows the state where the recorded dyeing layer 22', 23' is provided on the image-receptor 5.

Moving speeds of the dye transfer member 1 and the recording intermediate member 4 may be independently controlled as shown by arrows vl and v4. The speed of the dye transfer member 1 is controlled by a control system 9, 9' while that of the recording intermediate member 4 is controlled by another drum driving control system (not shown). Additionally, the moving speed v2 of the dyeing layer transfer member 2 may also be controlled independently of the speed v4 of the recording intermediate member 4. A driving control system 10,10' is for the speed v2. In the case where the transfer member 1 or 2 is moved following the driving force of the recording intermediate member 4, the independent driving systems 9, 9, and 10,10' may be dispensed with.

FIG. 2 shows another arrangement for explaining the thermal transfer printing method according to a second embodiment of the present invention.

In the embodiment of FIG. 2, as shown in the transfer member 100, the dyeing layer transfer member 2, the dye transfer member 1, and the molten ink transfer member 8 referred to in the embodiment of FIG. 1 are formed into one unit. More specifically, the thermal transfer of the dyeing layer, the subliming dye and the molten ink is effected by the same thermal head 3-2. In the transfer member 100, the dye layer 12-1 is formed in one color or in a plurality of colors by the face order subsequent to the dyeing layer portions 22 and 23, with the molten ink layer 82 being further provided. Since the process after the subliming dye has been recorded on the dyeing layer is the same as in the embodiment of Fig. 1, detailed description thereof is abbreviated for brevity, with like parts being designated by like reference numerals. In the embodiment of FIG. 2 also, the moving speeds of the transfer member 100 and the recording intermediate member 4 may be independently controlled respectively as indicated by arrows v100 and v4. The speed of the transfer member 100 is controlled by the control system 9, 9', while the speed of the recording intermediate member 4 is controlled by another drum driving system (not shown).

In the foregoing embodiments, the dye transfer member 1 includes a base material 11, a heat-resistant lubricity layer 13 formed on the reverse face of the base material 11, and dye layer 12 provided on the upper face thereof. The base material 11 is made of a high polymer film of 2 to 20 microns in thickness. For such a film, the PET (polyethylene terephthalate) film is generally employed, but films composed of resins capable of forming films such as aromatic polyimide (aramide), polyimide, polycarbonate, polyphenylene sulfide, polyether ketone, triacetyl cellulose, and cellophane, etc. are also useful for the purpose. Similarly, resistant films formed by mixing electrically conductive particles such as carbon, etc. into such resins may also be employed. The dye layer 12 is composed of at least a subliming dye and a bonding agent. For the subliming dye, the dispersing dye, oil soluble dye, basic dye, color former, etc. are used. Particularly, dispersing dyes of indoaniline group, quinophthalone group, dicyano imidazole group, dicyano methine group, tricyanovinyl group, etc. are useful. For the bonding agent, polyester, polyvinyl butyral, acrylstyrene resin, etc. are employed. The heat resistant lubricity layer 13 is provided to impart a lubricating characteristic between the thermal head 3 and the base material 11 and is formed into the film by the ultra-violet curing resin, liquid state lubricant, inorganic fine particles or the like. The dyeing layer transfer member 2 includes a base material 21 and dyeing layer portions 22 and 23 piled one upon another on said base material 21 (only the layer portion 23 serves the purpose depending on necessity). It is to be noted here that, although the dyeing layer includes the two layer portions 22 and 23, said dyeing layer is generally represented by a singular form as a dyeing layer 22, 23 throughout the specification and appended claims for the simplicity of expressions.

Here, the dyeing layer portions 22 and 23 are constituted by materials different in the surface energy of the dyeing resins thereof, and it is desired that the surface energy of the layer portions 22 contacting the base material 21 is smaller than that of the layer portion 23. As a typical dyeing resin having a small surface energy, polyvinyl butyral resin may be raised, while as a representative dyeing resin having the surface energy larger than the above, saturated polyester resin may be quoted. When such resins are evaluated by the separating bonded strength of the bonding materials corresponding to those in JIS (Japanese Industrial Standards) K 6854, the separating strength of the PET film and butyral resin is 10g/25mm, and that of the PET film and polyester resin is larger than 300g/25mm. Both of these materials may be mixed for application.

The dyeing layer may be added with a parting characteristic or lubricity. Since the dyeing layer is required to be transferred onto the image-receptor at the final process after the recording, the glass transition temperature Tg of the dyeing resin should preferably be as low as possible so long as no problem is brought about in the recording or printing. Although saturated polyester resin, polyacetal resin, acrylic resin, urethane resin, polyamide resin and composite groups thereof are useful, those having glass transition temperature Tg thereof lower than 90° C. is preferable. For lowering the glass transition temperature Tg as the system of the dyeing layer and also for the selective transfer of the dyeing layer onto the image-receptor, it is effective in many cases to add the lubricating material or parting material to be described later. Particularly, the material in which acrylsilicone resin (silicone) having siloxane methacrylate at the terminal or side chain is added to saturated polyester or acrylic resin, has a high transfer efficiency of the dyeing layer for recording and the image-receptor and also, a large selective transfer characteristic of the dyeing layer. For the transfer onto the image-receptor having a rough surface nature as in plain paper, etc. fine particles may be included in the dyeing layer. Especially, inorganic fine particles such as silica, titanium white, etc. which protrude from the surface of the dyeing layer are very effective.

Another thin parting layer of about 1 micron in thickness may be provided between the base material 21 and the dyeing layer 22. For the base material 21, similar material to that of the base material 11 of the dye transfer member may be employed. The parting layer may be partially imparted with an adhering property. For the above parting layer, a thin layer formed by silicone resin, fluoroplastic or the like, a layer formed by mixing and dispersing a parting agent into a general resin, or a layer prepared through reaction of a parting agent on a resin and the like. For the silicone resin, the resins for coating, separating paper, or adhesive paper, which may be formed into a film through additional polymerization or condensation polymerization are preferable. Meanwhile, for the fluoroplastics, polytetrafluoroethylene, tetrafluoroethylene· perfluoroalkylvinyl ether copolymer, vinylidene fluororide· hexafluoropropylene group rubber material, various fluorine containing resins are effective. For the parting agent or material to be added to resin, there are available various silicone group lubricants, fluorine group surface-active agent, waxes such as paraffine, and polyethylene, etc., higher fatty group alcohol, higher fatty acid amide and ester, etc. As the liquid state lubricants, dimethyl polysiloxane, methylphenylpolysiloxane, fluorosilicone oil, various denatured silicone oil, reactants of more than two kinds of reactive silicone oils (e.g. reactants of epoxy denaturation and carboxyl or amino denaturation, etc.) are employed. Similarly, reaction type of resin and lubricant may be employed, and for example, water soluble polysiloxane graft acrylic resin prepared by subjecting polysiloxane to graft polymerization with acrylic resin, acrylic silicons (silicone) resin added with siloxane methacrylate at the terminal or chain side or acrylurethane silicone (silicon) resin, etc. are effective.

For the recording intermediate member 4, a metallic drum or a high polymer film base material 41 of PET itself may be employed. The surface of the high polymer film 41 may be roughened by fine particles, lapping paper, etc., and the separating layer 42 having adhesive nature may be provided on the base material 41. For the parting layer 42, a thin rubber-like layer of silicone resin, fluoroplastic, etc., or a layer prepared by mixing and dispersing a parting agent into a general resin, or a layer in which a resin is reacted by a parting agent may be used. For the silicone resin, the resins for coating, separating paper, or adhesive paper, which may be formed into a film through additional polymerization or condensation polymerization are preferable. Meanwhile, for the fluoroplastics, polytetrafluoroethylene, tetrafluoroethylene· perfluoroalkylvinyl ether copolymer, vinylidene fluororide· hexafluoropropylene group rubber material, various fluorine containing resins are effective. For the parting agent or material to be added to resin, there are available various silicone group lubricants, fluorine group surface-active agent, waxes such as paraffine, and polyethylene, etc., higher fatty group alcohol, higher fatty acid amide and ester, etc. As the liquid state lubricants, dimethyl polysiloxane, methylphenylpolysiloxane, fluorosilicone oil, various denatured silicone oil, reactants of more than two kinds of reactive silicone oils (e.g. reactants of epoxy denaturation and carboxyl or amino denaturation, etc). Similarly, reaction type of resin and lubricant may be employed, and for example, water soluble polysiloxane graft acrylic resin prepared by subjecting polysiloxane to graft polymerization with acrylic resin, acrylic silicons (silicone) resin added with siloxane methacrylate at the terminal or chain side or acrylurethane silicone (silicone) resin, etc. are effective.

Figure 3:
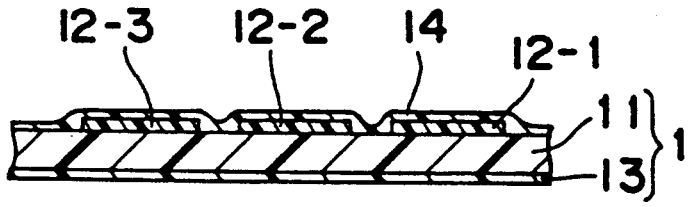
FIG. 3 is a fragmentary cross section showing another embodiment of the dye transfer member of the present invention.

Referring also to FIG. 3, there is shown another embodiment of the dye transfer member, in which a lubricity layer 14 is provided on the coloring material layers 12. By the above structure, a sharing force acting between the recording intermediate member 4 and the dye layer 22 (or 23) transferred thereon during the dye thermal transfer recording period may be reduced for stable printing. In the case where a relative speed many times recording is effected between the recording intermediate member 4 and the dye transfer member, this lubricity layer also serves as a color transmitting low density layer for stabilizing the recording density characteristic. The lubricity lay 14 is formed by mixing and dispersing a lubricating material into a resin.

For the lubricating material, there may be employed various silicone group lubricants, fluorine group surface-active agent, waxes such as paraffine, and polyethylene, etc., higher fatty group alcohol, higher fatty acid amide and ester, etc. As the liquid state lubricants, dimethyl polysiloxane, methylphenylpolysiloxane, fluorosilicone oil, various denatured silicone oil, reactants of more than two kinds of reactive silicone oils (e.g. reactants of epoxy denaturation and carboxyl or amino denaturation, etc). Similarly, reaction type of resin and lubricant may be employed, and for example, water soluble polysiloxane graft acrylic resin prepared by subjecting polysiloxane to graft polymerization with acrylic resin, acrylic silicons (silicone) resin added with siloxane methacrylate at the terminal or chain side or acrylurethane silicone (silicone) resins, etc. are effective.

A dye transmitting low color density layer may further be provided between the dye material layer 12 and the lubricity layer 14. Such low color density layer serves for protection of the dyeing layer and increase of the bonding strength between the dye layer and the lubricity layer.

Figure 4:
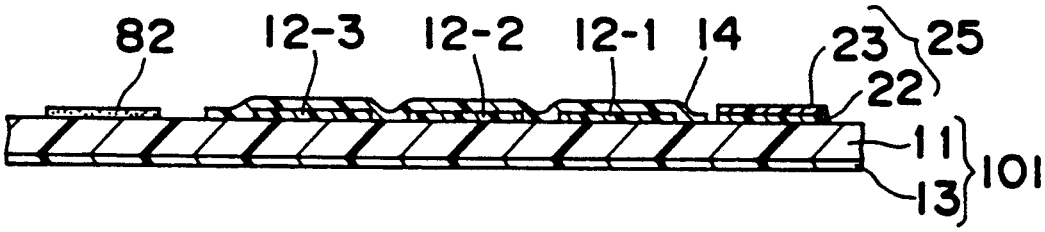
FIGS. 4, 5 and 6 are fragmentary cross sections showing embodiments of transfer members.
Figure 5:
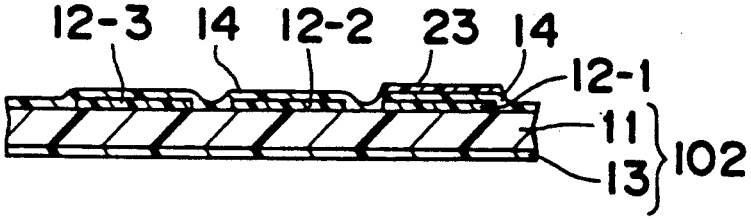
Figure 6:
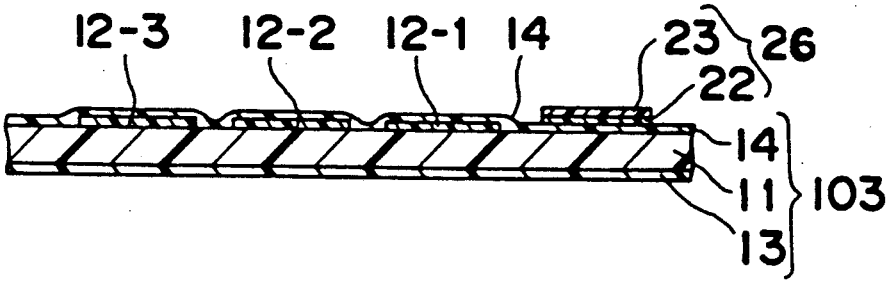

FIGS. 4, 5 and 6 show further embodiments of the transfer members to be applied to the thermal transfer printing method according to the second embodiment in FIG. 2.

In a transfer member 101 in FIG. 4, the lubricity layer 14 is provided on the dye layer portion in the transfer member 100 in FIG. 2. The laminated structure 25 of the dye layer portions 22 and 23 is formed at the portion where the lubricity layer is not present. In the transfer member 103 in FIG. 6, the laminated structure 26 of the dyeing layer portions 22 and 23 is provided on the lubricity layer 14 without the color material layer. In the transfer member 102 of FIG. 5, the color material layer 12-1, the lubricity layer 14 and the dyeing layer portion 23 are piled one upon another as illustrated. A bonding layer may also be formed between the dyeing layer and the parting layer. In the case of a transfer member in which coloring material layers in different colors are formed in the face order, the dyeing layer is formed on the first color layer.

Meanwhile, the image-receptor or image receiving material 5 may be of the pulp group paper such as the bond paper, plain paper, etc. or it may be of the synthetic paper such as a semi-translucent PET film YUPO, etc. or of a base material prepared by bonding pulp paper with a film.

For the recording heads 3-1,3-2 and 3-3, normal thermal heads, energizing heads, laser heads, etc. are employed. The recording conditions when the line type thermal head is employed are as follows. Line recording period T: 33ms to 4ms, impression pulse width: 16ms to 2ms, and recording energy E: 8 to 4 J/cm$^2$. The moving speeds of the dye transfer member 1 or 100 and the recording intermediate member 4 (vl(v100) and v4) are controlled by the independent control system 9,9' so as to be v1=v4, and it may be so arranged that a large sharing force is not applied between the recording intermediate member and the dyeing layer transferred thereon. In the case where the lubricity layer 14 is provided on the dye transfer member 1, many times recording by the relative speed recording as in the relation v1<v4 may be effected.

The moving speeds v2 and v4 of the dyeing transfer member 2 and the recording intermediate member 4 may also be controlled by an independent control system 10,10' so as to be v2=v4, and thus, it is arranged that a large sharing force is not applied between the base material of the dyeing layer transfer member and the dyeing layer 22, 23 formed thereon. The thermal transfer of the recorded dyeing layer onto the image-receptor 5 is effected under such conditions as temperature: about 180° C., speed: 10mm/sec., and pressure 4 kg/1cm when the heat roll 7 is employed.

FIG. 7 shows a further arrangement for explaining the thermal transfer printing method according to a third embodiment of the present invention.

In the embodiment of FIG. 7, through employment of the recording intermediate member 202 preliminarily provided with the dyeing layer directed along the drum 44, the ink transfer member (dye transfer member) 1 and the thermal head 2-1, the subliming dye of the dye layer 12 on the ink transfer member 1 is thermally diffused and transferred into the dyeing layer 22, 23 on the recording intermediate member. Subsequently, by using the molten ink transfer member 8 and the thermal head 3-2, the molten ink 82 is thermally transferred and recorded on the non-dyeing layer portion or dyeing layer portion on the recording intermediate portion. In the case of a printing apparatus not required to print characters, the portion by the combination of the molten ink transfer member 8 and the thermal head 3-2 is not required. Finally, by thermally transferring the item recorded on the recording intermediate member 202 (the image recorded in or on the dyeing layers 22, 23 or molten ink recorded on the non-dyeing layer portion), onto the image-receptor 5 through employment of a heat roller 7, a high quality image by the dye and molten thermal transfer printing can be obtained without depending on the quality of the material for the image-receptor. Numeral 6' shows the state where the recorded dyeing layer 22',23' and the recorded molten ink 82' are provided on the image-receptor 5, while numeral 202' represents the base material 21 after the recording item has been transferred onto the image-receptor. On the surface of the base material 21, a soft layer, for example, of a thin film or the like may be provided. The drum 44 may be in the form of a small platen as shown at 44' in FIG. 7. Since the specific constructions of the ink transfer member 1, the dyeing layer transfer member 2, and the molten ink transfer member 8 are similar to those in the embodiments of FIGS. 1 and 2, detailed description thereof is abbreviated for brevity, with like parts being designated by like reference numerals.

Hereinbelow, some specific examples are given for explaining the present invention, without any intention of limiting the scope thereof.

MANUFACTURE OF THE DYE TRANSFER MEMBER 1

On a PET film anchor layer of 4 microns provided with a lubricating heat resistant layer of 2 microns on a reverse surface, and painted with an anchor layer of 0.3 micron on the front surface, a dye layer was formed with ink as described below by a gravure coater so as to be 1 micron in a solid state thickness.

| (Ink) | |
|---|---|
| Indoaniline group disperse dye | 2.5 weight parts |
| Acrylstyrene resin | 4 weight parts |
| Amide denatured silicone oil | 0.02 weight part |
| Toluene | 20 weight parts |
| 2-butanone | 20 weight parts |

(Ink)

On the color material layer formed in the above described manner, only polyester resin was painted and dried to form a dried film of 0.2 micron in thickness as a dye transmitting low density layer.

Moreover, a paint having compositions as follows was prepared, and applied thereon to form a lubricity layer having a dry film thickness of 0.3 micron by a gravure coater.

Polysiloxane graft polymer aqueous dispersion (concentration 30%, PH 9.0): 10g

Polyvinylalcohol (Poval 420 name used in trade and manufactured by Kuraray Co., Ltd., Japan): 10 weight %, Water: 20g.

MANUFACTURE OF THE MOLTEN INK TRANSFER MEMBER 8

On a PET film 81 having a heat-resistant lubricity layer 83 of 1 micron formed at the reverse face, black molten ink 82 having the compositions as follows was applied to form a film having a thickness of 2 microns in the dried state.

Wax(NPS-6115, name used in trade and manufacture by Nippon Seiro Co., Ltd., Japan): 3 weight parts Heat melting resin (YS resin PX-100, name used in trade and manufacture by Yasuhara Yushi Kogyo Co., Ltd., Japan) 1 weight part Carbon black: 1 weight part Toluene· IPA mixed solvent: 10 weight parts

MANUFACTURE OF THE DYEING LAYER TRANSFER MEMBER 2

On a PET film of 12 microns in thickness, a dyeing layer as follows including two layer portions was formed.

As a first dyeing layer portion, a paint prepared by mixing 10 weight parts of polyvinylbutyral resin (BL-S, name used in trade and manufactured by Sekisui Chemical Co., Ltd., Japan) and 50 weight parts of toluene was applied thereon by a bar coater to obtain a film thickness of 1 micron. On the above first layer portion, as a second dyeing layer portion, a paint prepared by 10 weight parts of saturated polyester resin (Vylon 200, name used in trade and manufactured by TOYOBO Co., Ltd., Japan), 50 weight parts of toluene, and 0.1 weight part of silicone oil was applied to form a film having a thickness of 1 micron.

MANUFACTURE OF THE RECORDING INTERMEDIATE MEMBER 4

A structure in which a PET film of 25 micron thick was disposed on a metallic drum by applying pay-off and takeup tension for allowing speed control was used as the recording intermediate member.

Through employment of mechanisms for driving the dye transfer member 1, dyeing layer transfer member 2, and molten ink transfer member 8 and recording intermediate member 4 for recording, and a heat roller mechanism for continuously transfer the dyeing layer onto the image-receptor, printing was effected under the following conditions, and thus, final images were obtained on bond paper.

Recording head: line type thermal head

Line recording speed: 8ms

Recording pulse width: 0–4ms

Maximum dye recording energy: 6.5J/cmz

Maximum molten ink transfer energy: 2J/cm$^2$

Dyeing layer transfer energy: 3J/cm$^2$

Heat roller: temperature 180° C., feeding speed 10mm/sec. pressure 10kg.

The images obtained on the bond paper in the manner as described above were a high quality pictorial image with maximum reflection density of more than 1.8 and black letters with such density of more than 1.5.

Furthermore, further specific examples will be given hereinbelow.

MANUFACTURE OF THE DYE TRANSFER MEMBER 1

On a PET film anchor layer of 4 microns provided with a lubricating heat resistant layer of 2 microns on a reverse surface, and painted with an anchor layer of 0.3 micron on the front surface, a dye layer was formed with ink as described below by a gravure coater so as to be 1 micron in a solid state thickness.

| (Ink) | |
|---|---|
| Indoaniline group disperse dye | 2.5 weight parts |
| Acrylstyrene resin | 4 weight parts |
| Amide denatured silicone oil | 0.02 weight part |
| Toluene | 20 weight parts |
| 2-butanone | 20 weight parts |

MANUFACTURE OF THE MOLTEN INK TRANSFER MEMBER 8

On a PET film 81 having a heat-resistant lubricity layer 83 of 1 micron formed at the reverse face, black molten ink 82 having the compositions as follows was applied to form a film having a thickness of 2 microns in the dried state.

Wax(NPS-6115, name used in trade and manufacture by

Nippon Seiro Co., Ltd., Japan): 3 weight parts

Heat melting resin (YS resin PX-100, name used in trade and manufactured by Yasuhara Yushi Kogyo Co., Ltd., Japan): 1 weight part Carbon black: 1 weight part Toluene· IPA mixed solvent: 20 weight parts

MANUFACTURE OF THE DYEING LAYER TRANSFER MEMBER 2

On a PET film of 12 microns in thickness, a dyeing layer as follows including two layer portions was formed.

As a first dyeing layer portion, a paint prepared by mixing 10 weight parts of polyvinylbutyral resin (BL-S, name used in trade and manufactured by Sekisui Chemical Co., Ltd., Japan) of toluene was applied thereon by a bar coater to obtain a film thickness of 1 micron. On the above first layer portion, as a second dyeing layer portion, a paint prepared by 4 weight parts of saturated polyester resin (Vylon 200, name used in trade and manufactured by TOYOBO Co., Ltd., Japan), 6 weight parts of polyvinylbutyral resin, and 50 weight parts of toluene, was applied by a bar coater to formed a film having a thickness of 1 micron.

Through employment of mechanisms for driving the dye transfer member 1, and the recording intermediate member 202, and molten ink transfer member 8 and a heat roller mechanism for continuously transferring the recording item on the recording intermediate member onto the image-receptor, printing was effected under the following conditions, and thus, final images were obtained on bond paper.

Recording head: line type thermal head
Line recording speed: 8ms
Maximum dye recording energy: 6.5J/cm$^2$
Maximum molten ink transfer energy: 2J/cm$^2$
Dyeing layer transfer energy: 3J/cm$^2$
Heat roller: temperature 180° C., feeding speed 10mm/sec. pressure 40kg The images obtained on the bond paper in the manner as described above were a high quality pictorial image with maximum reflection density of more than 1.8 and black letters with such density of more than 1.5.

Although the present invention has been fully described by way of example with reference to the accompanying drawings, it is to be noted here that various changes and modifications will be apparent to those skilled in the art. Therefore, unless otherwise such changes and modifications depart from the scope of the present invention, they should be construed as included therein.

What is claimed is:

1. A thermal transfer printing method which employs a dyeing layer transfer member having at least a dyeing layer on a base material, a dye transfer member having at least a dye layer on a base material, a recording intermediate member having a base material formed into a drum configuration and an elastic layer on its surface, and an image-receptor, said thermal transfer printing method comprising the steps of thermally transferring the dyeing layer of said dyeing layer transfer member onto the recording intermediate member, thermally transferring and recording the dye of said dye transfer member onto said transferred dyeing layer according to image signals, and further thermally transferring and fixing said recorded dyeing layer onto said image-receptor.

2. A thermal transfer printing method as claimed in claim 1, wherein said dyeing layer and said dye layer are provided on the same base material.

3. A thermal transfer printing method which employs a dyeing layer transfer member having at least a dyeing layer on a base material, a dye transfer member having at least a dye layer on a base material, a molten ink transfer member having at least a molten ink layer on a base material, recording intermediate member having a base material formed into a drum configuration and an elastic layer on its surface, and an image-receptor, said thermal transfer printing method comprising the steps of thermally transferring the dyeing layer of said dyeing layer transfer member onto the recording intermediate member, thermally transferring and recording the dye of said dye transfer member onto said transferred dyeing layer according to the image signals, also thermally transferring and recording the ink of said molten ink transfer member onto said transferred dyeing layer according to image signals, and further thermally transferring and fixing said recorded dyeing layer onto said image-receptor from said recording intermediate member.

4. A thermal transfer printing method as claimed in claim 3, wherein said dyeing layer, said dye layer and said molten ink layer are provided on the same base material.

5. A thermal transfer printing method which employs a dyeing layer transfer member having at least a dyeing layer on a base material, a dye transfer member having at least a dye layer on a base material, a molten ink transfer member having at least a molten ink layer on a base material, a recording intermediate member having a base material formed into a drum configuration and an elastic layer on its surface, and an image-receptor, said thermal transfer printing method comprising the steps of thermally transferring the dyeing layer of said dyeing layer transfer member onto the recording intermediate member, thermally transferring and recording the dye of said dye transfer member onto said transferred dyeing layer recording the ink of said ink transfer member onto said printing intermediate member not transferred with the dyeing layer according to image signals, and further thermally transferring and fixing the dyeing layer recorded by the dye and the recorded molten ink onto said image-receptor.

6. A thermal transfer printing method as claimed in claim 5, wherein said dyeing layer, said dye layer, and said molten ink layer are provided on the same base material.

7. A thermal transfer printing method as claimed in any one of claims 1 or 5 wherein said dyeing layers on said base material are selectively thermally transferred and recorded onto said recording intermediate member, and said transferred dyeing layer is subjected to selective dye thermal transfer and recording, and/or said dyeing layer is subjected to molten ink thermal transfer and recording.

8. A thermal transfer printing method as claimed in any one of claims 3 or 5 wherein said dyeing layers on said base material are selectively thermally transferred and recorded onto said recording intermediate member, and said transferred dyeing layer is subjected to selective dye thermal transfer and recording, and/or molten ink thermal transfer and recording is effected onto said recording intermediate member not transferred with said dyeing layer.

9. A thermal transfer printing method as claimed in any one of claims 1 or 5, wherein moving speeds between said dyeing layer transfer member and said recording intermediate member, and/or between said recording intermediate member and said dye transfer member and/or between said recording intermediate member and said molten ink transfer member are independently controlled.

* * * * *